US010744627B2

(12) United States Patent
Andrews

(10) Patent No.: US 10,744,627 B2
(45) Date of Patent: Aug. 18, 2020

(54) PRESS TOOL SYSTEMS AND METHODS

(71) Applicants: Michael Andrews, Bellingham, WA (US); Tiger Tool International Incorporated, Abbotsford (CA)

(72) Inventor: Michael Andrews, Bellingham, WA (US)

(73) Assignee: Tiger Tool International Incorporated, Abbotsford (CA)

( * ) Notice: Subject to any disclaimer, the term of this patent is extended or adjusted under 35 U.S.C. 154(b) by 10 days.

(21) Appl. No.: 15/753,930

(22) PCT Filed: Mar. 2, 2017

(86) PCT No.: PCT/US2017/020496
§ 371 (c)(1),
(2) Date: Feb. 20, 2018

(87) PCT Pub. No.: WO2017/151953
PCT Pub. Date: Sep. 8, 2017

(65) Prior Publication Data

US 2018/0370002 A1 Dec. 27, 2018

Related U.S. Application Data

(60) Provisional application No. 62/303,755, filed on Mar. 4, 2016.

(51) Int. Cl.
*B25B 27/06* (2006.01)
*B25B 1/10* (2006.01)
(Continued)

(52) U.S. Cl.
CPC ..... *B25B 27/062* (2013.01); *B25B 1/103* (2013.01); *B25B 1/2457* (2013.01); *B25B 5/101* (2013.01); *B25B 5/163* (2013.01)

(58) Field of Classification Search
CPC .. B25B 5/06; B25B 5/067; B25B 5/10; B25B 5/101; B25B 5/14; B25B 5/16;
(Continued)

(56) References Cited

U.S. PATENT DOCUMENTS 1,131,868 A 3/1915 Ridlon
1,498,638 A * 6/1924 Periolat ..... B25B 5/101 269/47
(Continued)

FOREIGN PATENT DOCUMENTS

DE 10221280 C1 8/2003
FR 2670703 A1 6/1992
(Continued)

OTHER PUBLICATIONS

International Searching Authority, ISR & Written Opinion, PCT/IB2015/002481, dated May 10, 2017, 6 pages.
(Continued)

*Primary Examiner* — Tyrone V Hall, Jr.
(74) *Attorney, Agent, or Firm* — Michael R. Schacht; Schacht Law Office, Inc.

(57) ABSTRACT

A press tool employs a drive system that allows a first portion to be displaced relative to a second portion. A drive surface is supported by the second portion. A receiving member defines an engaging surface and a receiving cavity. The receiving member is supported by the first portion along a drive axis extending through the drive surface. Operation of the drive system displaces the drive surface relative to the receiving member.

15 Claims, 12 Drawing Sheets

(51) Int. Cl.
*B25B 1/24* (2006.01)
*B25B 5/10* (2006.01)
*B25B 5/16* (2006.01)

(58) Field of Classification Search
CPC ..... B25B 5/163; B25B 1/2457; B25B 1/2452; B25B 1/2405; B25B 1/10; B25B 27/00; B25B 27/02; B25B 27/023
See application file for complete search history.

(56) References Cited

U.S. PATENT DOCUMENTS

| | | | | |
|---|---|---|---|---|
| 1,552,616 | A | 9/1925 | Jake | |
| 1,682,956 | A | 9/1928 | Dawson et al. | |
| 1,849,805 | A * | 3/1932 | Raymond | B25B 5/101 269/212 |
| 1,996,967 | A | 4/1935 | Kratky | |
| 2,374,861 | A | 5/1945 | Graham | |
| 2,427,948 | A | 9/1947 | Cornwell | |
| 2,681,501 | A | 6/1954 | Albert | |
| 3,237,291 | A * | 3/1966 | Kelso | B25B 27/023 29/257 |
| 4,195,398 | A | 4/1980 | Matthews | |
| 4,428,105 | A | 1/1984 | Abbott et al. | |
| 4,624,039 | A | 11/1986 | Lawrence et al. | |
| 4,649,615 | A | 3/1987 | Hundley | |
| 4,941,252 | A | 7/1990 | Haisch et al. | |
| 4,976,280 | A | 12/1990 | Lagana | |
| 4,977,660 | A * | 12/1990 | Maynard | B25B 27/062 29/251 |
| 5,163,665 | A | 11/1992 | Klearman | |
| 5,174,005 | A | 12/1992 | Somerville | |
| 5,181,303 | A | 1/1993 | Gregg | |
| 5,224,254 | A | 7/1993 | McPeak et al. | |
| 5,341,553 | A | 8/1994 | Herzhauser | |
| 5,419,027 | A | 5/1995 | McPeak et al. | |
| 5,535,973 | A | 7/1996 | Bailey et al. | |
| 5,557,833 | A | 9/1996 | Pool | |
| 5,857,252 | A * | 1/1999 | Jansen | B25B 27/062 29/251 |
| 5,887,328 | A | 3/1999 | Rydin et al. | |
| 5,898,985 | A | 5/1999 | Villarreal | |
| 5,983,474 | A | 11/1999 | Koppe | |
| 6,505,390 | B2 | 1/2003 | Emanuel | |
| 7,117,573 | B1 | 10/2006 | Hu | |
| 7,213,317 | B2 | 5/2007 | Hu | |
| 7,387,296 | B2 * | 6/2008 | Alberti | B25B 5/067 269/143 |
| 7,475,465 | B1 | 1/2009 | Weiss | |
| 7,669,305 | B1 * | 3/2010 | Lionberg | B25B 5/101 29/255 |
| 7,669,306 | B2 | 3/2010 | Palka | |
| 7,685,688 | B2 | 3/2010 | Fan | |
| 7,895,723 | B2 * | 3/2011 | Wridt | B25B 27/062 269/143 |
| 8,567,292 | B1 * | 10/2013 | Park | B25B 5/101 269/214 |
| 8,689,420 | B2 | 4/2014 | Barrios et al. | |
| 9,718,177 | B1 | 8/2017 | Bell | |
| 2012/0110815 | A1 * | 5/2012 | Brown | B21J 15/50 29/426.5 |
| 2012/0272499 | A1 | 11/2012 | Schley et al. | |
| 2018/0207776 | A1 | 7/2018 | Andrews | |

FOREIGN PATENT DOCUMENTS

| | | | |
|---|---|---|---|
| JP | 3160459 | U | 6/2010 |
| SU | 654401 | A2 | 3/1979 |
| SU | 1505740 | A1 | 9/1989 |
| TW | 306377 | U | 5/1997 |
| TW | 471371 | U | 1/2002 |
| TW | M342918 | U | 10/2008 |
| TW | M497081 | U | 3/2015 |
| WO | 2016063140 | A3 | 6/2016 |
| WO | 2017151953 | A1 | 9/2017 |

OTHER PUBLICATIONS

International Searching Authority, ISR & Written Opinion, PCT/US2017/020496, dated Jun. 1, 2017, 7 pages.
USPTO, "Non-Final Office Action, U.S. Appl. No. 15/520,196" dated Apr. 2, 2019, 8 pages.

* cited by examiner

PRESS TOOL SYSTEMS AND METHODS

RELATED APPLICATIONS

This application, U.S. patent application Ser. No. 15/753,930 filed Feb. 20, 2018 is a 371 of International PCT Application No. PCT/US2017/020496 filed Mar. 2, 2017.

International PCT Application No. PCT/US2017/020496 claims benefit of U.S. Provisional Application Ser. No. 62/303,755 filed Mar. 4, 2016.

The contents of all related applications are incorporated herein by reference.

TECHNICAL FIELD

The present invention relates to assembly and disassembly of universal joints (U-joints) and, more specifically, to press tool systems and methods that can be easily configured to accommodate universal joints of different sizes and configurations.

BACKGROUND

Universal joins, or U-joints, are commonly used in mechanical systems. U-joints typically require repair and maintenance after a period of use. The repair and maintenance of a U-joint typically require that the U-joint be disassembled, worn parts repaired and/or replaced, and then reassembly of the U-joint.

In particular, a typical U-joint comprises a shaft defining arms, a yoke, a cross, and a bushing that connects the arms to the cross. Different U-joints employ different bushings of different sizes and dimensions. Disassembly and reassembly of a U-joint typically requires removal and replacement of the bushing. The bushing must be forced or pressed out of the space between the arms and the cross. To remove the bushing, force must be applied to the bushing while the arms and cross are held in place and also while minimizing damage to the components of the U-joint.

The need thus exists for improved press tools for assembling and disassembling a U-joint.

SUMMARY

The present invention may be embodied as a press tool comprising a drive system configured to allow a first portion to be displaced relative to a second portion, a drive surface that is supported by the second portion, and a receiving member defining an engaging surface and a receiving cavity. The receiving member is supported by the first portion along a drive axis extending through the drive surface. Operation of the drive system displaces the drive surface relative to the receiving member.

The present invention may also be embodied as a method of assembling a device having a first part and a second part, the method comprising the following steps. A drive system configured to allow a first portion to be displaced relative to a second portion is provided. A drive surface is supported on the second portion. A receiving member defining an engaging surface and a receiving cavity is provided. The receiving member is supported on the first portion along a drive axis extending through the drive surface. The drive system is arranged such that the first and second parts of the device are arranged along the drive axis. The drive system is operated such that the drive surface engages the first part of the device and the engaging surface engages the second part of the device such that the first part is displaced relative to the second part into the receiving cavity.

A press tool comprising a drive system, a first socket drive, and a second socket drive. The drive system is configured to allow a first portion to be displaced relative to a second portion. The first socket drive defines an engaging surface and a receiving cavity. A second socket drive defines a drive surface. The first socket device is supported by the first portion along a drive axis. The second socket drive is supported by the second portion such that the drive axis extends through the drive surface. Operation of the drive system displaces the drive surface relative to the engaging surface.

DETAILED DESCRIPTION

Figure 1:
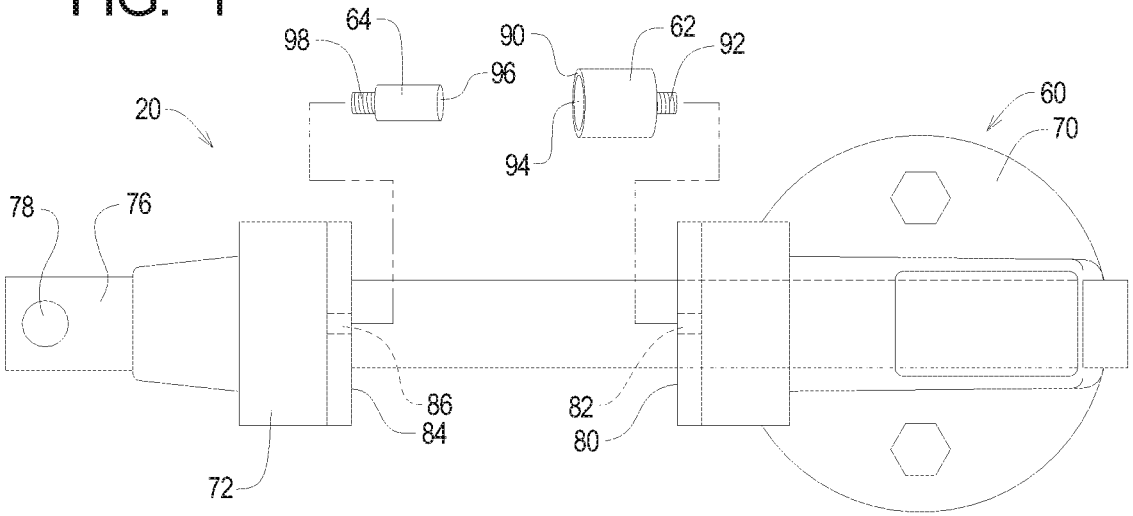
FIG. 1 is a top plan, partially exploded view of a first example press tool of the present invention.

The principles of the present invention may be embodied in different physical forms, and several example press tools of the present invention will be described below.

I. First Example U-Joint Tool

Referring initially to FIGS. 1-9 of the drawing, depicted therein is a first example press tool 20 constructed in accordance with, and embodying, the principles of the present invention. FIGS. 2 and 4-9 illustrate the use of the first example press tool 20 to disassemble an example universal joint 22.

The universal joint 22 is or may be conventional, is shown and described herein by way of example only, and does not per se form a part of the first example press tool 20 of the present invention. The example universal joint 22 will thus be described herein only to the extent necessary for a complete understanding of the construction and operation of the example press tools of the present invention. In addition, universal joints come in a variety of sizes and configurations, and the first example press tool 20 may be reconfigured to accommodate different sizes and configurations of universal joints as will be described in further detail below.

As is conventional, the universal joint comprises a shaft 30, a yoke 32, and a cross 34. The terms "shaft", "yoke", and "cross" are used herein somewhat arbitrarily for clarity and do not indicate that the present invention is to be used to disassemble or reassemble a particular type of universal joint. The shaft 30 defines first and second shaft arms 40 and 42 connected to the cross 34 by first and second shaft bushings 44 and 46. The term "bushing" is used herein as a shorthand to refer to an assembly that operatively connects the arm of a universal joint to a cross of a universal joint. A "bushing" as that term is used herein typically comprising a bushing, roller bearing, seal(s), and/or seal retainer(s), but the use of the term "bushing" does not indicate that the present invention is to be used to disassemble or reassemble a particular type of universal joint. The yoke 32 defines first and second yoke arms, but only the first yoke arm 50 is visible in FIGS. 2 and 4-9. The first and second yoke arms are connected to the cross 34 by first and second yoke bushings, but only the first yoke bushing 52 is visible in FIGS. 2 and 4-9. The cross 34 defines first and second cross axis C1 and C2, respectively.

Figure 2:
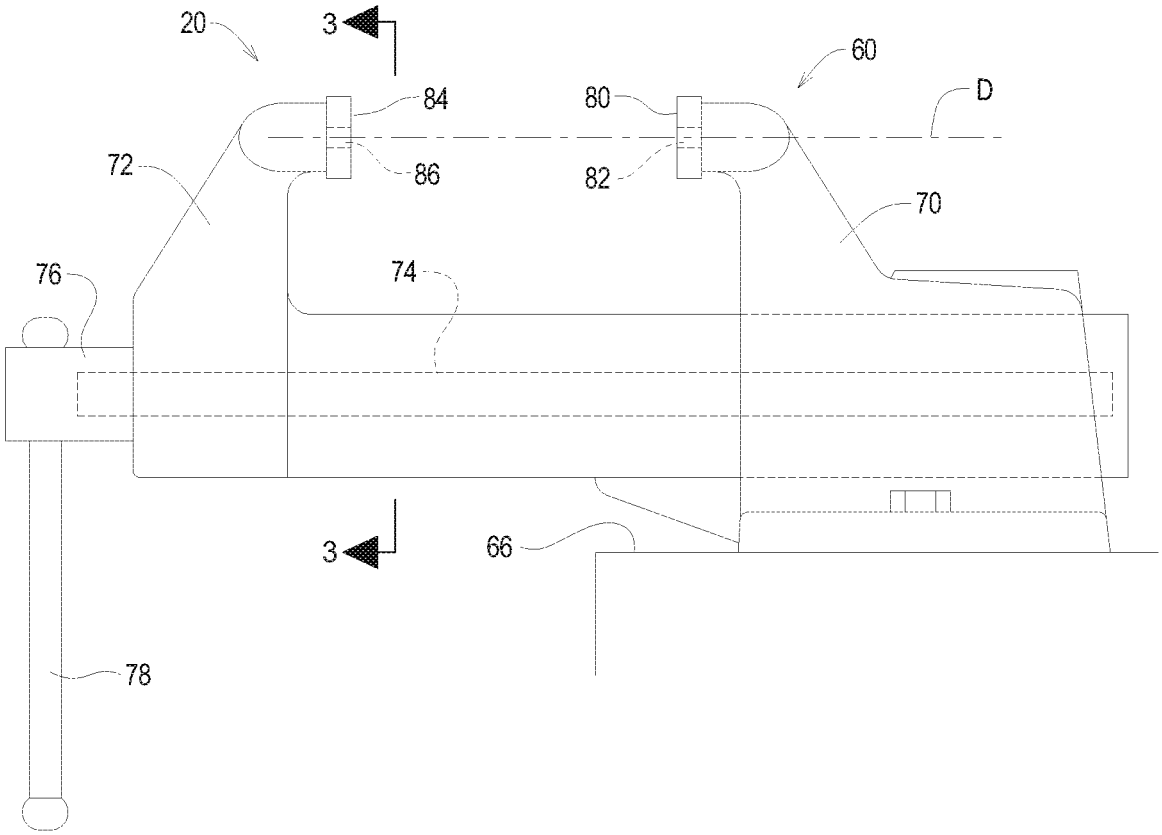
FIG. 2 is a side elevation view of a first example linear drive system that may be used by the first example press tool.
Figure 3:
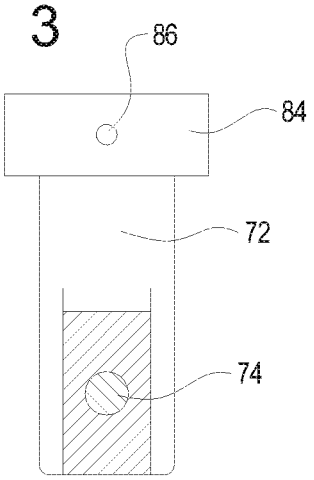
FIG. 3 is a section view taken along lines 3-3 in FIG. 2.
Figure 4:
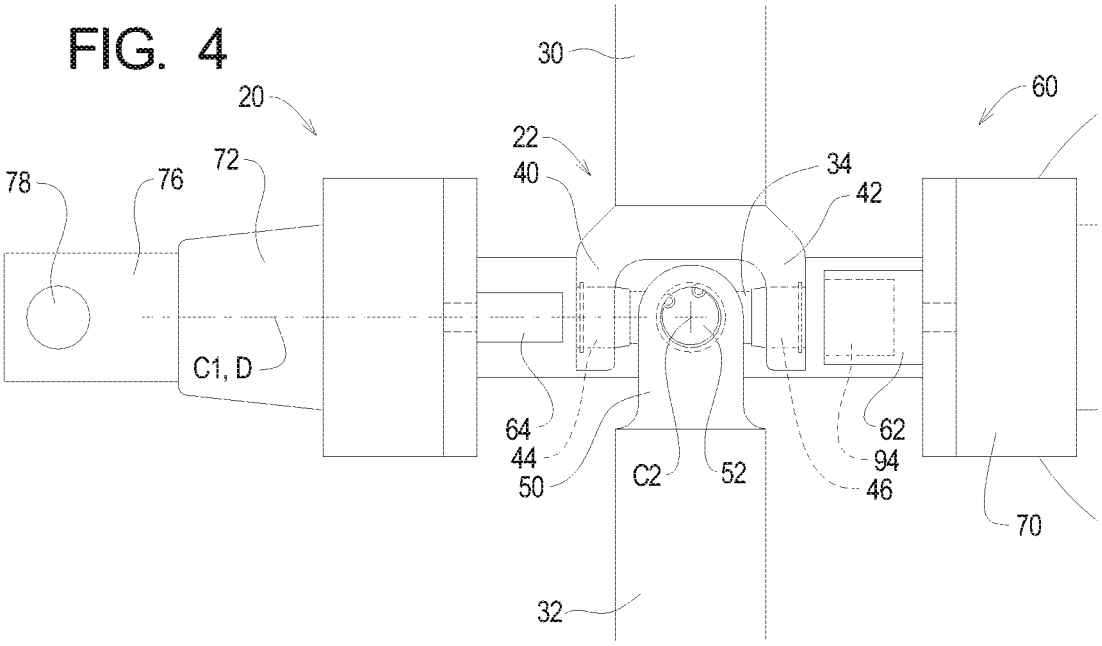
FIG. 4 is a top plan view illustrating a first step in a method of using the first example press tool to disassemble an example universal joint by removing a first shaft bushing.

Turning now for a moment back to FIGS. 1-3, it can be seen that the first example press tool 20 comprises a linear drive system 60, a receiving member 62, and a drive member 64. The first example press tool 20 is adapted to be supported on a work surface 66.

The example linear drive system 60 comprises a stationary member 70, a movable member 72, a threaded member 74, a collar 76, and a handle 78. The stationary member 70 defines a stationary engaging surface 80 in which is formed a stationary connecting portion 82. The movable member 72 defines a movable engaging surface 84 that defines a movable connecting portion 86. A drive axis D extends through the stationary and movable connecting portions 82 and 86. The example stationary and movable connecting portions 82 and 86 are formed by cavities and may be referred to by the terms "stationary cavity 82" and "movable cavity 86" below.

The movable member 72 is supported for linear movement relative to the stationary member 70. The threaded member 74 extends through the movable member 72 and engages the stationary member 70 such that axial rotation of the threaded member 74 causes linear movement of the threaded member 74 relative to the stationary member 70. The collar 76 is secured to the threaded member 74 and engages the movable member 72 such that linear movement of the threaded member 74 causes linear movement of the movable member 72 relative to the stationary member 70. The handle 78 facilitates axial rotation of the threaded member 74. As will be apparent from the following discussion, the example linear drive system 60 may be constructed and operated in manner similar to that of a conventional bench vice.

The receiving member 62 defines a first head surface 90, a first head projection 92, and a first head cavity 94. The drive member 64 defines a second head surface 96 and a second head projection 98. The first head projection 92 of the receiving member 62 is sized and dimensioned to be received within the stationary drive cavity 82. The second head projection 98 is sized and dimensioned to be received within the movable drive cavity 86.

In use, the stationary member 70 is arranged on, and may be secured to, the work surface 66. The receiving and drive members 62 and 64 are selected so that the cavity 94 of the receiving member 62 is capable of receiving (e.g., larger diameter than) the second bushing 46 and the second engaging surface 96 of the drive member 64 is capable of applying a driving force to the first bushing 44 as will be described in further detail below.

The receiving member 62 is then arranged such that the first head projection 92 is received by the stationary drive cavity 82, and the drive member 64 is arranged such that the second head projection 98 is received by the movable drive cavity 86. In the example drive system 60, the first and second head projections 92 and 98 are externally threaded, and the first and second drive cavities 82 and 86 are complementarily internally threaded. The threaded head projections 92 and 98 and connecting cavities 82 and 86 thus facilitate the detachable attachment of the receiving and drive members 62 and 64 to the stationary and movable members 70 and 72, but other detachable attachment systems may be used in addition or instead as will be described in further detail below. The first and second drive members 62 and 64 are thus detachably attached to the stationary engaging surface 80 and the movable engaging surface 84, respectively.

Figure 5:
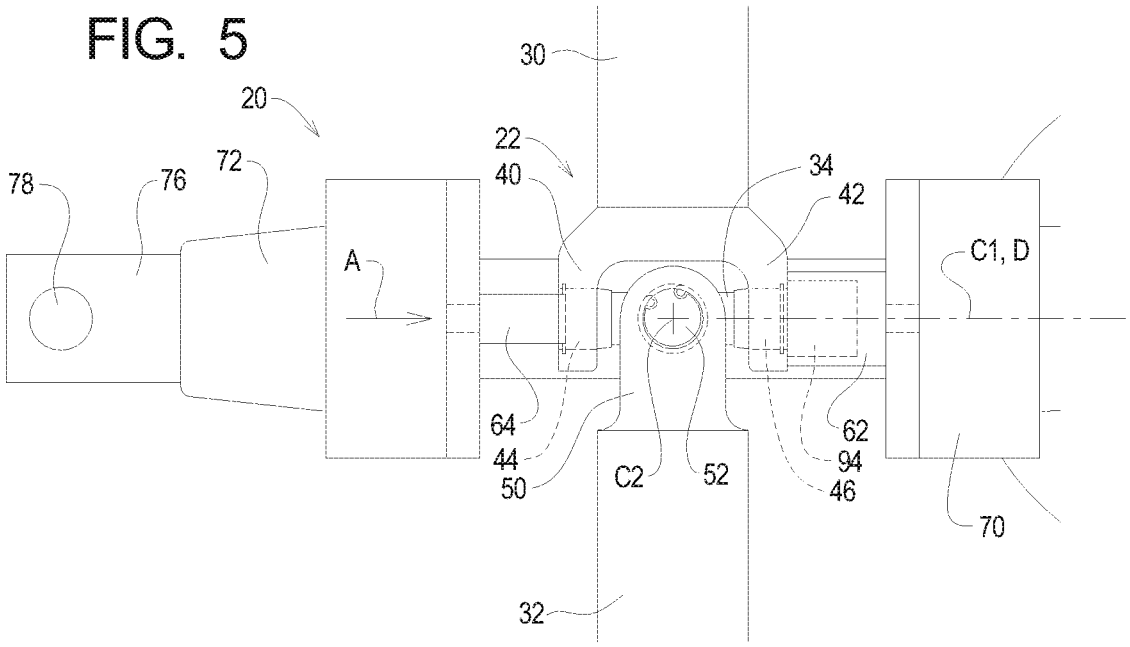
FIG. 5 is a top plan view illustrating a second step in the method of using the first example press tool to disassemble the example universal joint.
Figure 6:
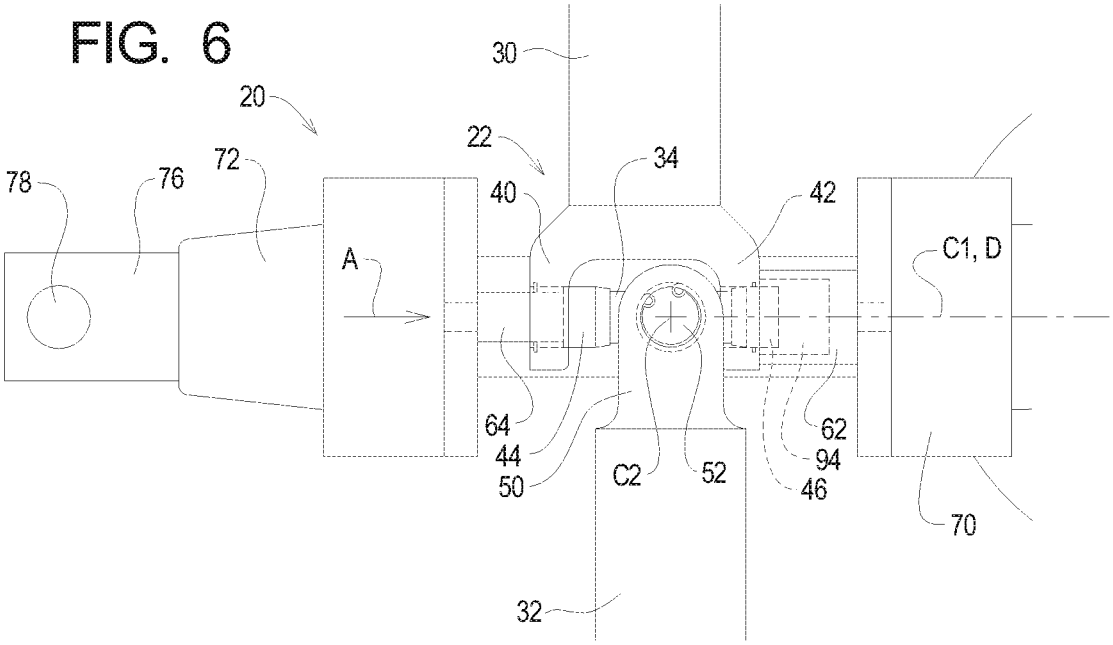
FIG. 6 is a top plan view illustrating a third step in the method of using the first example press tool to disassemble the example universal joint.
Figure 7:
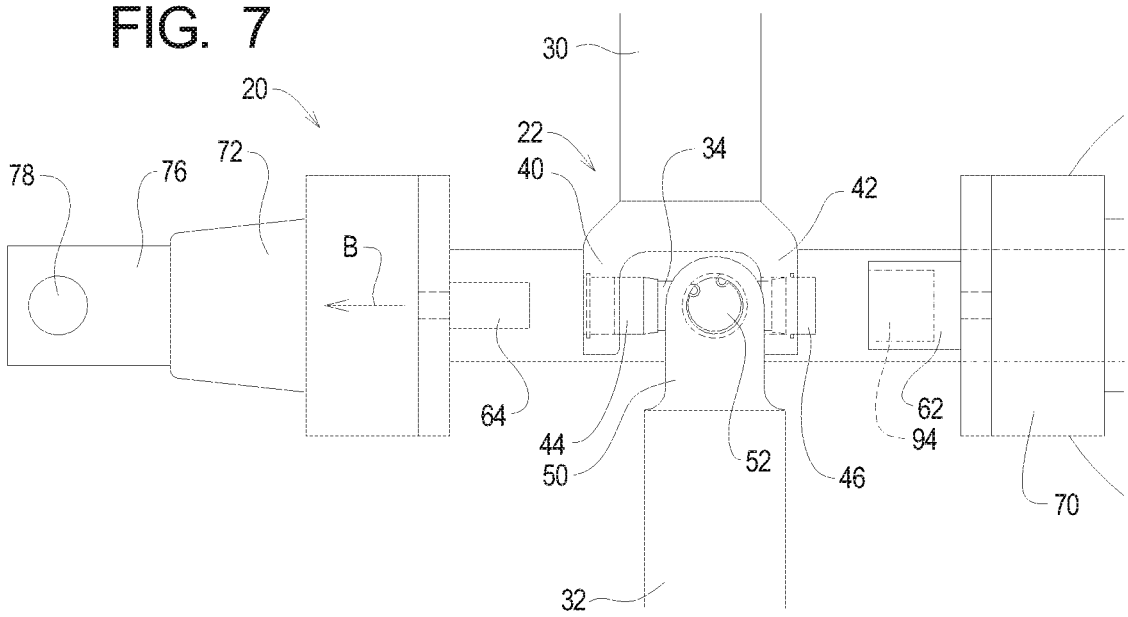
FIG. 7 is a top plan view illustrating a fourth step in the method of using the first example press tool to disassemble the example universal joint.
Figure 8:
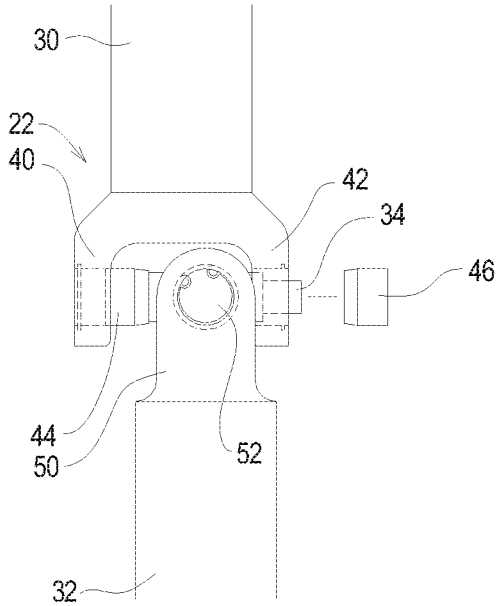
FIG. 8 is a top plan view illustrating a fifth step in the method of disassembly the example universal joint using the first example press tool.

The universal joint 22 is then arranged relative to the press tool 20 such that the cross 34 is between the receiving and drive members 62 and 64 and the first cross axis C1 is aligned with the drive axis D. The handle 78 is operated to rotate the threaded member 74 to displace the movable member 72 in the direction of arrow A such that the receiving member 62 engages the second shaft arm 42 and the second drive member 64 engages the first shaft bushing 44 as shown in FIG. 5. Continued operation of the handle 78 causes the second drive member 64 to displace the first shaft bushing 44, and thus the cross 34 and second shaft bushing 46 supported thereby, relative to the second shaft arm 42 until the second shaft bushing 46 is forced at least partly out of the opening in the second shaft arm 42 as shown in FIG. 6. The receiving cavity 94 is sized and dimensioned to receive the second shaft bushing 46 as the second shaft bushing 46 is forced out of the opening in the second shaft arm 42 as shown in FIG. 6. The handle 78 is then operated to rotate the threaded member 74 in the opposite direction shown by arrow B in FIG. 7 such that the receiving and drive members 62 and 64 disengage from the universal joint 22. At this point, the second shaft bushing 46 is loosened and may be easily removed from the opening in the second shaft arm 42 as shown in FIG. 8.

Figure 9:
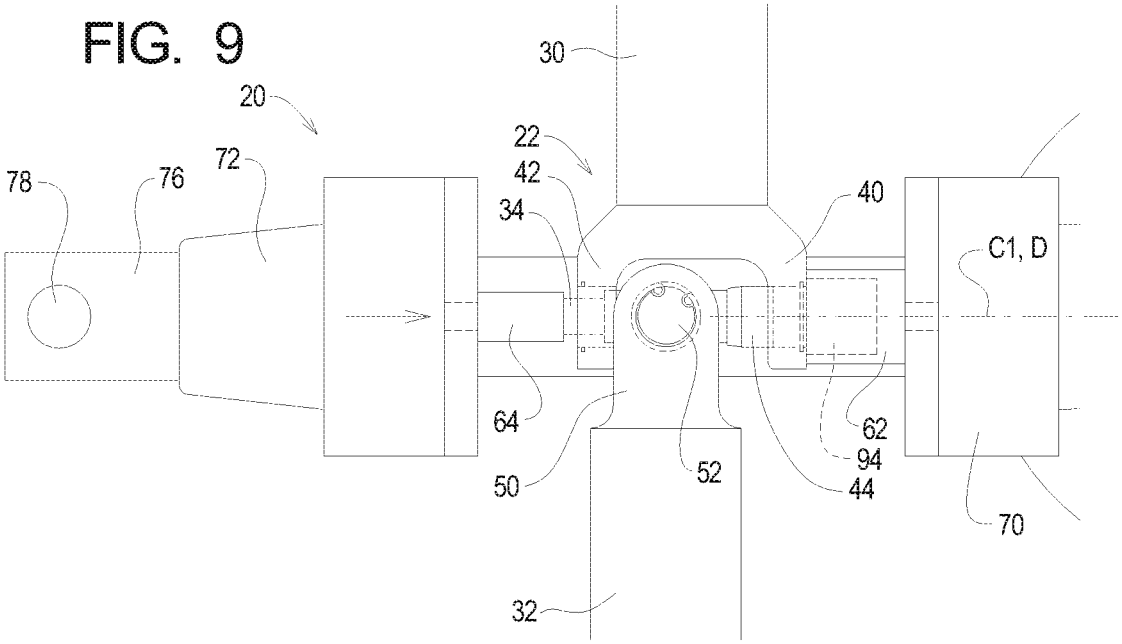
FIG. 9 is a top plan view illustrating a step in a method of using the first example press tool to disassemble the example universal joint by removing a second shaft bushing.

The universal joint 22 is then arranged relative to the press tool 20 such that the cross 34 is between the receiving and drive members 62 and 64 and the first cross axis C1 is aligned with the drive axis D as shown in FIG. 9. However, when arranged as shown in FIG. 9, the first shaft arm 40 is adjacent to the receiving member 62 and the second shaft arm 42 is adjacent to the drive member 64. The handle 78 is again operated to rotate the threaded member 74 to displace the movable member 72, but this time the receiving member 62 engages the first shaft arm 40 and the second drive member 64 engages the cross 34, the first shaft bushing 44 having already been removed. Continued operation of the handle 78 causes the second drive member 64 to displace the the cross 34, and thus the first shaft bushing 44 still supported thereby, relative to the first shaft arm 40 until the first shaft bushing 44 is forced at least partly out of the opening in the first shaft arm 40. The receiving cavity 94 is sized and dimensioned to receive the first shaft bushing 44 as the first shaft bushing 44 is forced out of the opening in the first shaft arm 40. The handle 78 is then operated to rotate the threaded member 74 in the opposite direction such that the receiving and drive members 62 and 64 disengage from the universal joint 22. At this point, the first shaft bushing 44 is loosened and may be easily removed from the opening in the first shaft arm 40.

The first and second yoke bushings may similarly be removed by following the same steps described above, but with the second cross axis C2 aligned with the drive axis D.

The first example press tool 20 of the present invention may be used to reassemble a universal joint such as the example universal joint 22. In particular, the first shaft bushing 44 (or a suitable replacement first shaft bushing 44) is first pressed partly into the opening of the first shaft arm 40. The universal joint 22 is then arranged such that the cross 34 is between the receiving and drive members 62 and 64 with the first cross axis C1 aligned with the drive axis D and the second shaft arm 42 facing the receiving member 62. Operating the handle 78 displaces the second drive member 64 to engage the first shaft bushing 44 and force the second shaft arm 42 against the receiving member 62. Continued operation of the handle 78 forces the first shaft bushing 44 into the opening in the first shaft arm 40. The second shaft bushing 46 and the yoke bushings may similarly be replaced by rotating the universal joint 22 such that the appropriate cross axis C1 or C2 is aligned with the drive axis and the receiving member 62 faces the bushing to be installed (or reinstalled).

II. Second Example U-Joint Tool

Figure 11:
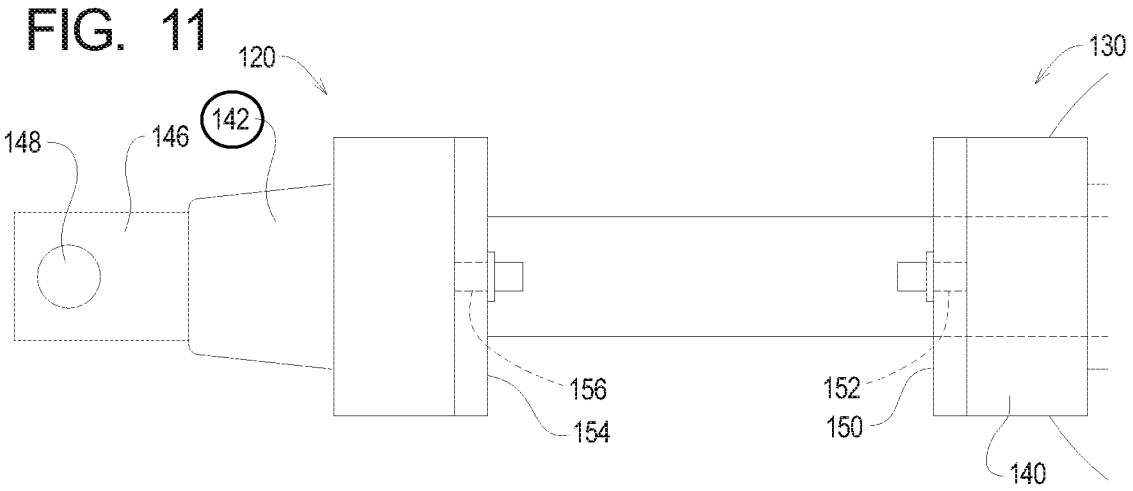
FIG. 11 is a top plan view illustrating a first step in a process of assembling the second example press tool of the present invention.
Figure 12:
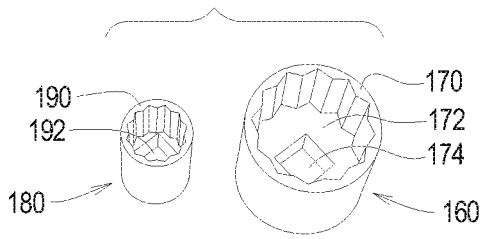
FIG. 12 is a perspective view illustrating drive and receiving members that may be used by the second example press tool of the present invention.
Figure 13:
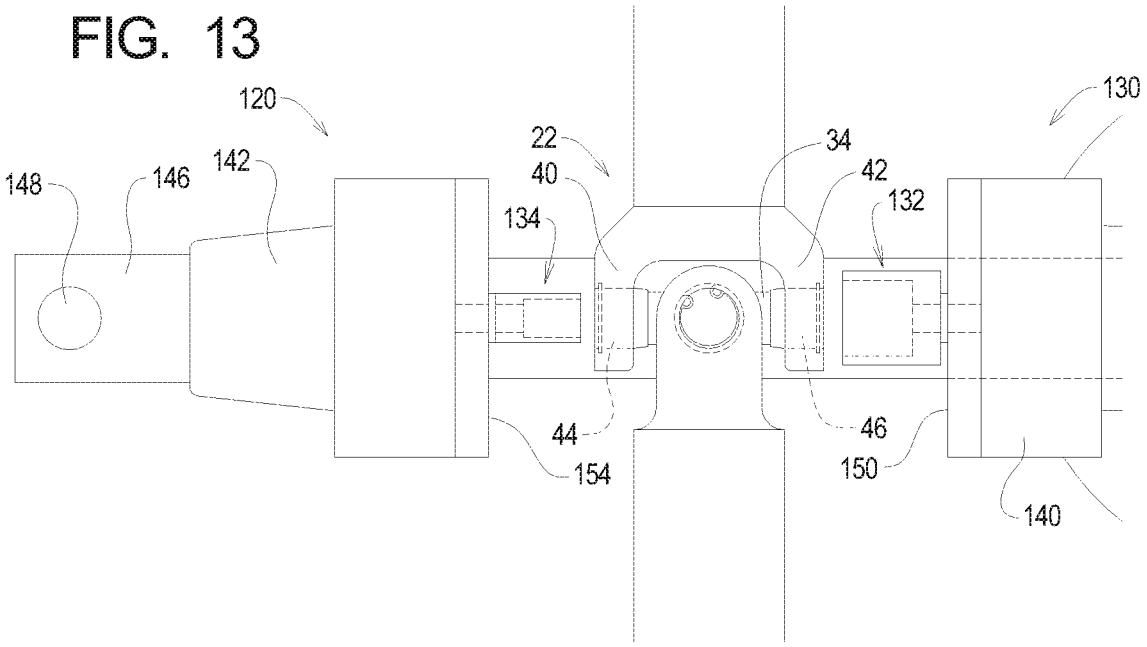
FIG. 13 is a top plan view illustrating a first step in a method of using the second example press tool to disassemble an example universal joint.

Referring now to FIGS. 10-13 of the drawing, depicted therein is a second example press tool 120 constructed in accordance with, and embodying, the principles of the present invention. FIG. 13 illustrates the first step in a method of using the second example press tool 120 to disassemble the example universal joint 22 described above.

Figure 10:
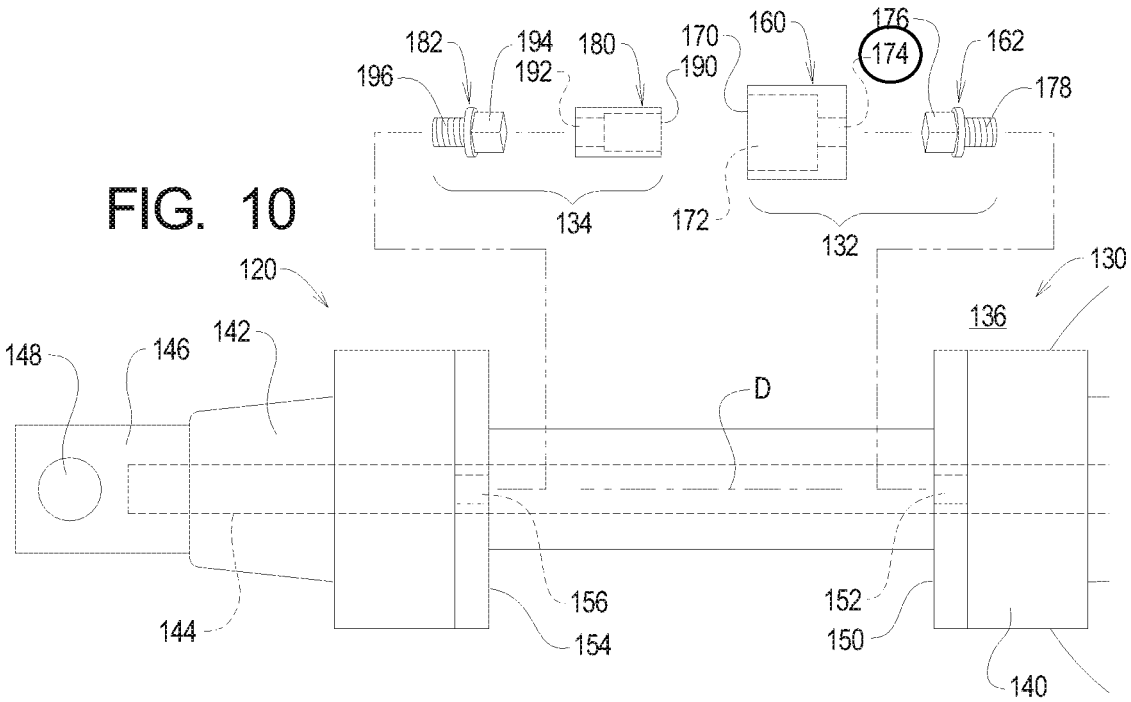
FIG. 10 is a top plan, partially exploded view of a second example press tool of the present invention.

FIGS. 10-12 illustrate that the second example press tool 120 comprises a linear drive system 130, a first drive assembly 132, and a second drive assembly 134. The second example press tool 120 is adapted to be supported on a work surface 136.

The example linear drive system 130 comprises a stationary member 140, a movable member 142, a threaded member 144, a collar 146, and a handle 148. The stationary member 140 defines a stationary engaging surface 150 in which is formed a stationary connecting portion 152. The movable member 142 defines a movable engaging surface 154 that defines a movable connecting portion 156. A drive axis D extends through the stationary and movable connecting portions 152 and 156. The movable member 142 is supported for linear movement relative to the stationary member 140. The threaded member 144 extends through the movable member 142 and engages the stationary member 140 such that axial rotation of the threaded member 144 causes linear movement of the threaded member 144 relative to the stationary member 140. The collar 146 is secured to the threaded member 144 and engages the movable member 142 such that linear movement of the threaded member 144 causes linear movement of the movable member 142 relative to the stationary member 140. The handle 148 facilitates axial rotation of the threaded member 144. As will be apparent from the following discussion, the example linear drive system 130 may be constructed and operated in manner similar to that of a conventional bench vice.

The first drive assembly 132 comprises a first drive head 160 and a first drive base 162. The first drive head 160 defines a first head surface 170, a first drive head cavity 172, and a first connecting portion 174. The first drive base 162 defines second and third connecting portions 176 and 178. The second drive assembly 134 comprises a second drive head 180 and a second drive base 182. The second drive head 180 defines a second head surface 190 and a fourth connecting portion 192. The second drive base 182 defines fifth and sixth connecting portions 194 and 196.

In use, the stationary member 140 is arranged on, and may be secured to, the work surface 136. Using the first, second, and third connecting portions 184, 186, and 188, the first drive assembly 132 is detachably attached to the stationary engaging surface 150. Using the fourth, fifth, and sixth connecting portions 192, 194, and 196, the second drive assembly 134 is detachably attached to the stationary connecting portion 152.

More specifically, the first and second connecting portions 174 and 176 engage each other to detachably attached first drive head 160 to the first drive base 162. The third connecting portion 178 of the first drive assembly 132 is sized and dimensioned to be received within a cavity defining the stationary connecting portion 152 to detachably attach the first drive base 162 to the stationary member 140. The fourth and fifth connecting portions 192 and 194 engage each other to detachably attach the second drive head 180 to the second drive base 182. The third connecting portion 196 of the second drive assembly 134 is sized and dimensioned to be received within the movable connecting portion 156 to detachably attach the second drive base 182 to the movable member 142.

In the example linear drive system 130, the first and fourth connecting portions 174 and 192 are formed by a female square drive, the second and fifth connecting portions 176 and 194 are formed by a male square drive, the third and sixth connecting portions 178 and 196 are formed by externally threaded projections, and the stationary and movable connecting portions 152 and 156 are formed by internally threaded cavities.

Alternatively, the third and sixth connecting portions 178 and 196 may be formed by a male square drive that directly engages the female square drives forming the first and fourth connecting portions 174 and 192, but this arrangement would inhibit use of the linear drive system 130 as a conventional bench vice. As another alternative, the first and fourth connecting portions 174 and 192 may be formed by male square drives and the stationary and movable connecting portions 152 and 156 may be formed by female square drives, but this arrangement would preclude the use of industry standard socket drives as the receiving and drive heads 160 and 180 as will be described in further detail below.

The receiving and drive heads 160 and 180 are selected so that the cavity 172 of the first member 160 is capable of receiving (e.g., larger diameter than) the second bushing 46, and the second engaging surface 190 of the second drive member 180 is capable of applying a driving force to the first bushing 44 as will be described in further detail below. In this example, the first drive heads 160 and second drive head 180 may be formed by standard socket drives for a socket wrench. A set of relatively inexpensive, off-the-shelf socket drives allows the user to adapt the second example press tool 120 to accommodate a wide variety of sizes, shapes, and configurations of universal joints in addition to the example universal joint 22 by selecting an appropriate socket drive as the receiving and drive heads 160 and 180.

Assembled as described above, the second example press tool 120 may then be used in the same manner as the first example press tool 20 as depicted in FIGS. 4-9 to disassemble a universal joint such as the example universal joint 22. When disassembling the universal joint, the example first drive head cavity 172 forms a receiving cavity like the example receiving cavity 94 described above. By reversing the process depicted in FIGS. 4-9, the second example press tool 120 may, like the first example press tool 20, also be used to reassemble the universal joint 22.

III. Third Example U-Joint Tool

Figure 14:
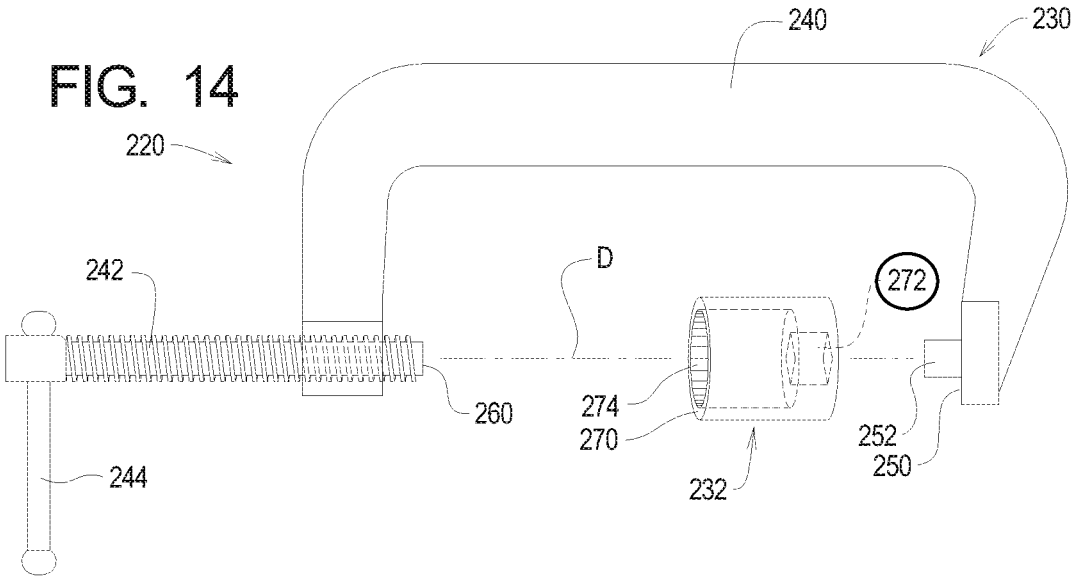
FIG. 14 is a side elevation, partial perspective, partially exploded view of a third example press tool of the present invention.
Figure 15:
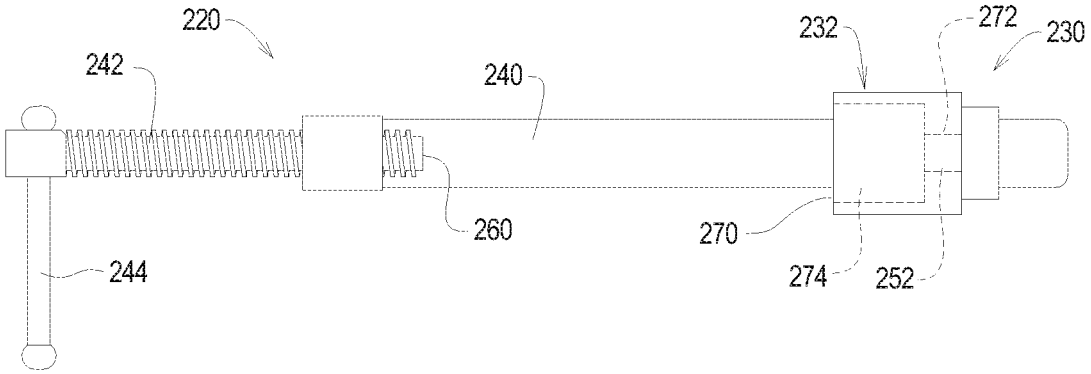
FIG. 15 is a top plan view of the third example press tool of the present invention.
Figure 16:
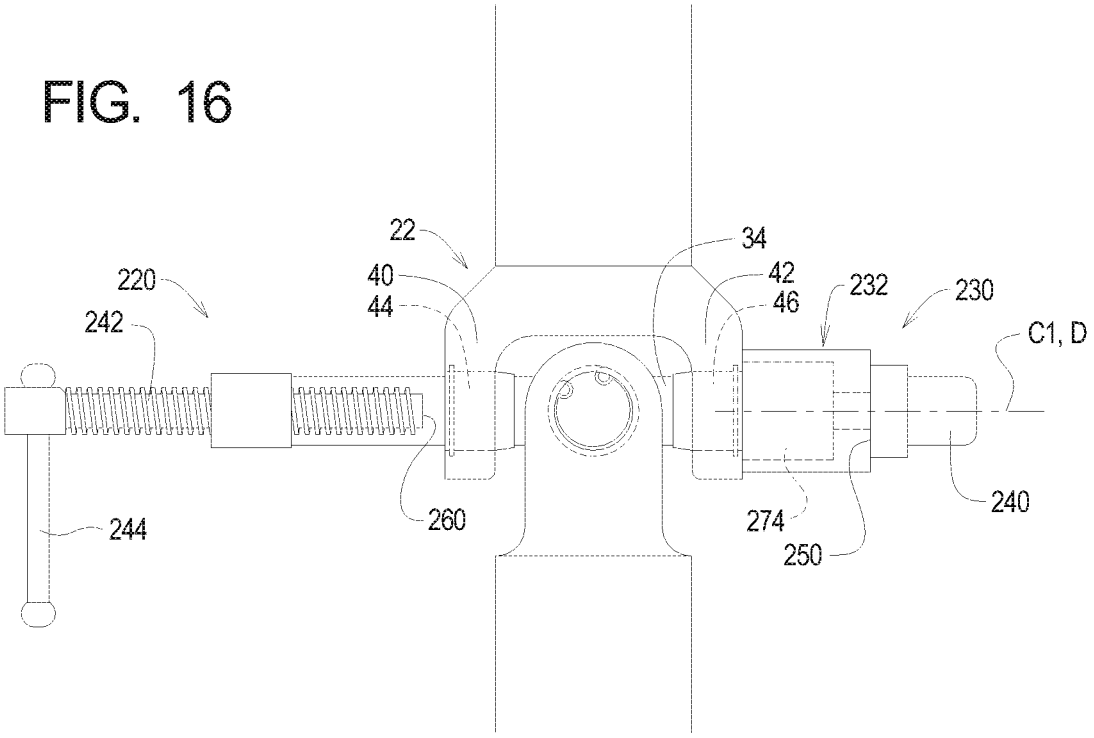
FIG. 16 is a top plan view illustrating a first step in a method of using the third example press tool to disassemble an example universal joint.
Figure 17:
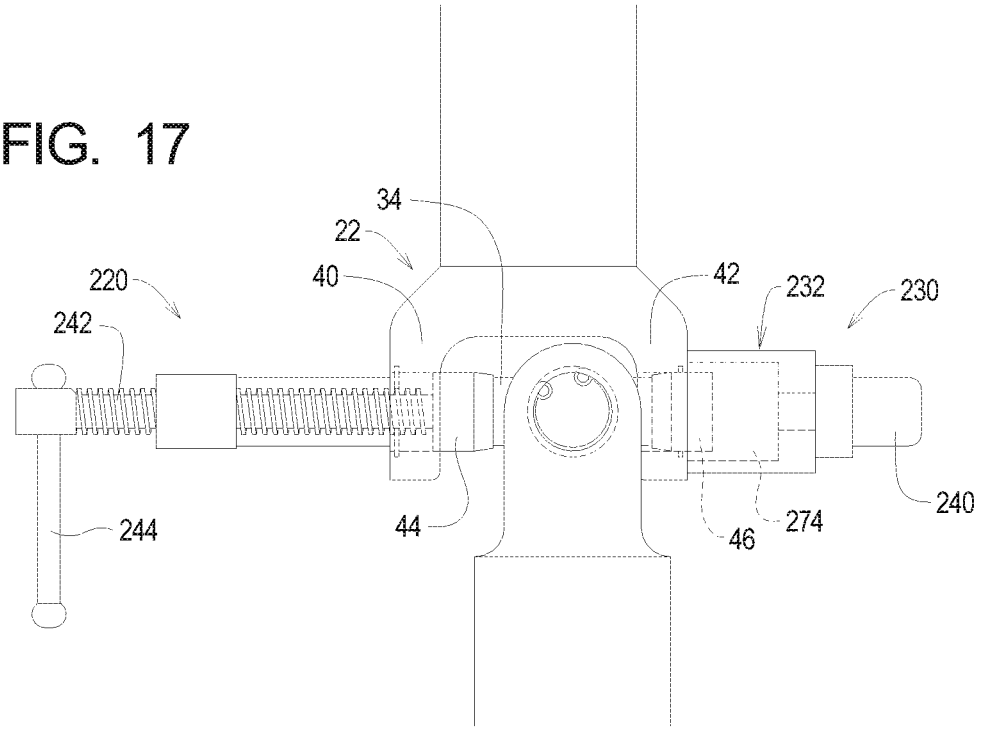
FIG. 17 is a top plan view illustrating a second step in the method of using the third example press tool to disassemble the example universal joint.

Referring now to FIGS. 14-17 of the drawing, depicted therein is a third example press tool 220 constructed in accordance with, and embodying, the principles of the present invention. FIGS. 14 and 15 illustrate that the third example press tool 220 comprises a linear drive system 230 and a receiving member 232. FIGS. 16 and 17 illustrate the first and second steps in a method of using the third example press tool 220 to disassemble the example universal joint 22 described above.

The example linear drive system 230 comprises a base member 240, a threaded member 242, and a handle 244. Except for as noted below, the example linear drive system 230 may be constructed and operated in manner similar to that of a conventional C-clamp and is typically not directly supported by a work surface. The base member 240 defines a base surface 250 and a first connecting portion 252. The example first connecting portion 252 is integrally formed with the base member 240 but may be detachably attached thereto. The threaded member 242 defines a drive surface 260. A drive axis D extends through the first connecting portion 252 and the drive surface 260. The threaded member 242 engages the base member 240 such that axial rotation of the threaded member 242 causes linear movement of the threaded member 242 relative to the base member 240. The handle 244 is arranged to facilitate axial rotation of the threaded member 242.

The receiving member 232 defines an engaging surface 270, a second connecting portion 272, and a receiving cavity 274. The second connecting portion 272 is configured to engage the first connecting portion 252 to detachably attach the receiving member to the base surface 250 of the base member 240.

In use, the receiving member 232 is detachably attached to the base member 240 using the first and second connecting portions 252 and 272. In the example linear drive system 230, the first connecting portion 252 is formed by a male square drive and the second connecting portion 272 is formed by a female square drive. In this example, the receiving member 232 may thus be formed by standard socket drives for a socket wrench. A set of relatively inexpensive, off-the-shelf socket drives allows the user to adapt the third example press tool 220 to accommodate a wide variety of sizes, shapes, and configurations of universal joints in addition to the example universal joint 22.

Alternatively, the second connecting portion 272 may be formed by a male square drive that directly engages a female square drives forming the first connecting portions 252, but this arrangement would preclude the use of industry standard socket drives as the receiving member 232.

The receiving head 270 is selected so that the receiving cavity 274 is capable of receiving (e.g., larger diameter than) the second bushing 46 and the drive surface 260 of the threaded member 242 is capable of applying a driving force to the first bushing 44 as will be described in further detail below.

Assembled as described above, the third example press tool 220 may then be used to disassemble and/or reassemble a universal joint such as the example universal joint 22. The first two steps in the process of disassembling the example universal joint 22 using the third example press tool 220 are shown in FIGS. 16 and 17. As shown in FIG. 16, the threaded member 242 is initially spaced from the base surface 250 and receiving member 232 detachably attached thereto a distance sufficient to allow the press tool 220 to be arranged such that the universal joint 22 is arranged relative to the press tool 220 such that the cross 34 is between the receiving member 232 and the drive surface 260. At this point, the first cross axis C1 is aligned with the drive axis D.

The handle 244 is then operated to rotate the threaded member 242 to displace the threaded member 242 such that the receiving member 232 engages the second shaft arm 42 and the drive surface 260 engages the first shaft bushing 44 as shown in FIG. 17. Similar to what is shown in FIG. 6, continued operation of the handle 244 causes the drive surface 260 to displace the first shaft bushing 44, and thus the cross 34 and second shaft bushing 46 supported thereby, relative to the second shaft arm 42 until the second shaft bushing 46 is forced at least partly out of the opening in the second shaft arm 42 as shown in FIG. 6. The receiving cavity 274 is sized and dimensioned to receive the second shaft bushing 46 as the second shaft bushing 46 is forced out of the opening in the second shaft arm 42.

The handle 244 is then operated to rotate the threaded member 242 in the opposite direction such that the receiving member 232 and drive surface 260 disengage from the universal joint 22. At this point, the second shaft bushing 46 is loosened and may be easily removed from the opening in the second shaft arm 42.

The third example press tool 220 may thus be used in the same general manner as the first and second example press tools 20 and 120 (similar to what is depicted in FIGS. 4-9) to disassemble a universal joint such as the example universal joint 22. By reversing that process, the third example press tool 220 may, like the first and second example press tools 20 and 120, also be used to reassemble the universal joint 22.

IV. Fourth Example U-Joint Tool

Figure 18:
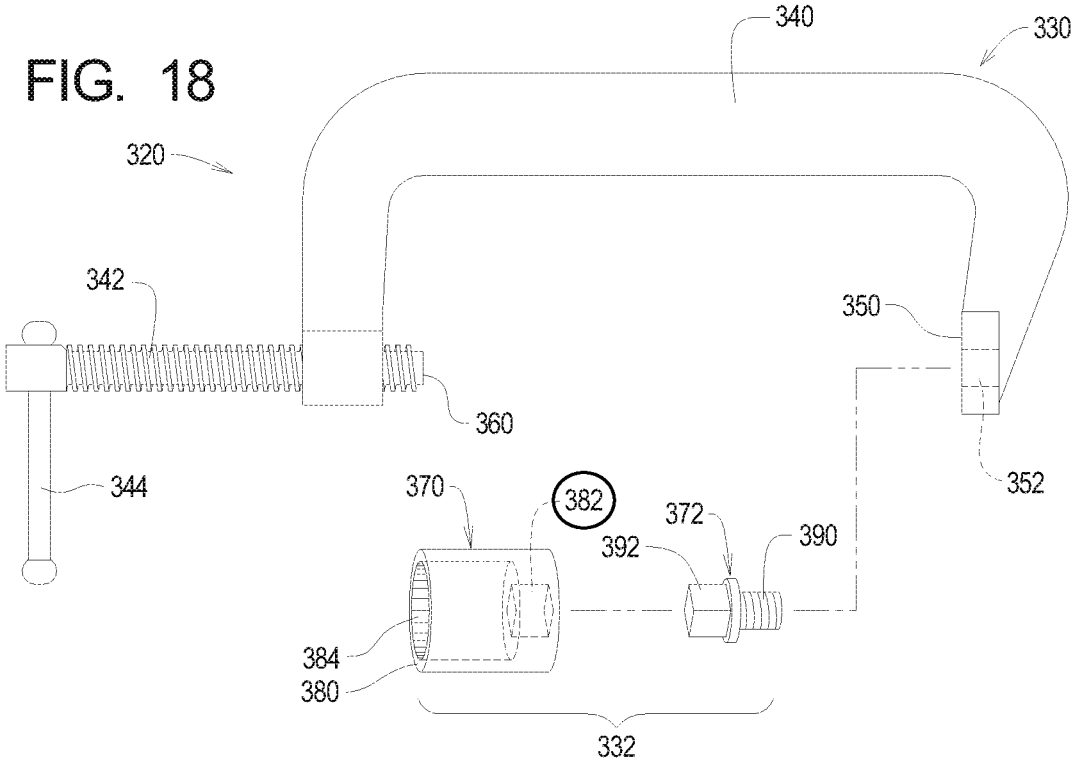
FIG. 18 is a side elevation, partial perspective, partially exploded view of a fourth example press tool of the present invention.
Figure 19:
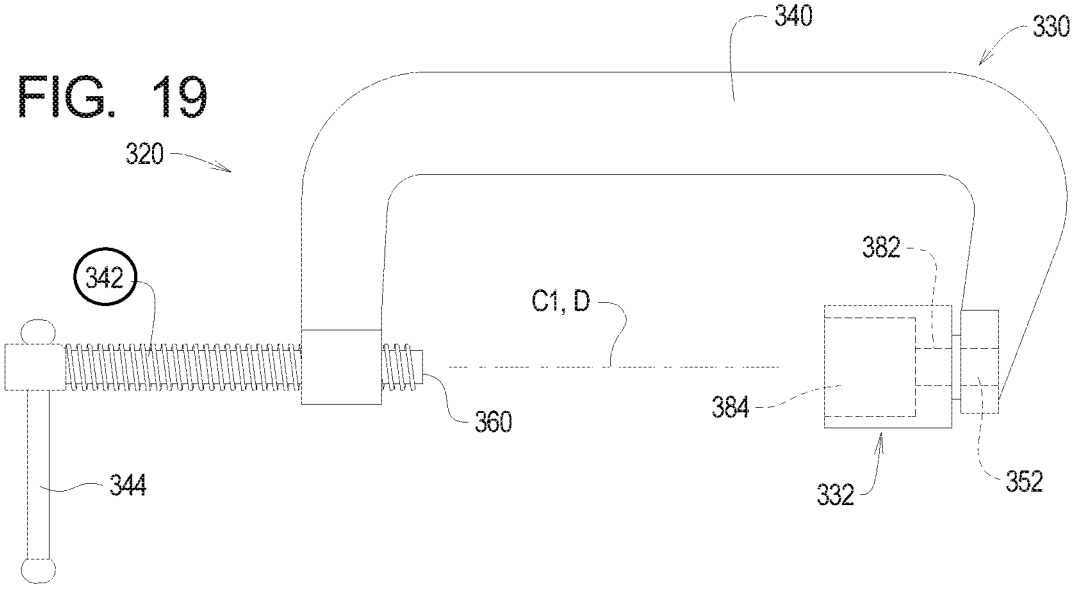
FIG. 19 is a top plan view of the fourth example press tool of the present invention.

Referring now to FIGS. 18 and 19 of the drawing, depicted therein is a fourth example press tool 320 constructed in accordance with, and embodying, the principles of the present invention. FIGS. 18 and 19 illustrate that the fourth example press tool 320 comprises a linear drive system 330 and a receiving assembly 332. The first and second steps in a method of using the fourth example press tool 320 to disassemble the example universal joint 22 described above would be similar to the steps depicted in FIGS. 16 and 17.

The example linear drive system 330 comprises a base member 340, a threaded member 342, and a handle 344. Except for as noted below, the example linear drive system 330 may be constructed and operated in manner similar to that of a conventional C-clamp and is typically not directly supported by a work surface. The base member 340 defines a base surface 350 and a first connecting portion 352. The example first connecting portion 352 is integrally formed with the base member 340 but may be detachably attached thereto. The threaded member 342 defines a drive surface 360. A drive axis D extends through the first connecting portion 352 and the drive surface 360. The threaded member 342 engages the base member 340 such that axial rotation of the threaded member 342 causes linear movement of the threaded member 342 relative to the base member 340. The handle 344 is arranged to facilitate axial rotation of the threaded member 342.

The receiving assembly 332 comprises a receiving member 370 and an adapter member 272. The receiving member 370 defines an engaging surface 380, a second connecting portion 382, and a receiving cavity 384. The adapter member 272 defines third and fourth connecting portions 390 and 392. The third connecting portion 390 is configured to engage the first connecting portion 352 to detachably attach the adapter member 372 to the base surface 350 of the base member 340. The second connecting portion 382 is configured to engage the fourth connecting portion 392 to detachably attach the receiving member 370 to the adapter member 372. Accordingly, with the receiving member 370 detachably attached to the adapter member 372 and the adapter member 372 detachably attached to the base member 340, the receiving member 370 is detachably attached to the base member 340.

In use, the receiving assembly 332 is detachably attached to the base member 340 using the first, second, third, and fourth connecting portions 352, 382, 390, and 392. In the example linear drive system 330, the first connecting portion 352 is formed by a threaded cavity and the third connecting portion 390 is formed by a threaded projection complementary to the threaded cavity forming the first connecting portion 352. Alternatively, the first and third connecting portions 352 and 390 may be formed by complementary square drives (one male, one female). Also in this example, the second connecting portion 382 is formed by a female square drive and the fourth connecting portion 392 is formed by a male square drive. The example receiving member 370 may thus be formed by standard socket drives for a socket wrench. A set of relatively inexpensive, off-the-shelf socket drives allows the user to adapt the fourth example press tool 320 to accommodate a wide variety of sizes, shapes, and configurations of universal joints in addition to the example universal joint 22.

The receiving member 370 is selected so that the receiving cavity 384 is capable of receiving (e.g., larger diameter than) the second bushing 46 and the drive surface 360 of the threaded member 342 is capable of applying a driving force to the first bushing 44 as will be described in further detail below.

Assembled as described above, the fourth example press tool 320 may then be used to disassemble and/or reassemble a universal joint such as the example universal joint 22. The first two steps in the process of disassembling the example universal joint 22 using the fourth example press tool 320 are similar to those shown in FIGS. 16 and 17. The threaded member 342 is initially spaced from the base surface 350 and receiving assembly 332 detachably attached thereto a distance sufficient to allow the press tool 320 to be arranged such that the universal joint 22 is then arranged relative to the press tool 320 with the cross 34 between the receiving assembly 332 and the drive surface 360. At this point, the first cross axis C1 is aligned with the drive axis D.

The handle 344 is then operated to rotate the threaded member 342 to displace the threaded member 342 such that the receiving assembly 332 engages the second shaft arm 42 and the drive surface 360 engages the first shaft bushing 44. Similar to what is shown in FIG. 6, continued operation of the handle 344 causes the drive surface 360 to displace the first shaft bushing 44, and thus the cross 34 and second shaft bushing 46 supported thereby, relative to the second shaft arm 42 until the second shaft bushing 46 is forced at least partly out of the opening in the second shaft arm 42 as shown in FIG. 6. The receiving cavity 384 is sized and dimensioned to receive the second shaft bushing 46 as the second shaft bushing 46 is forced out of the opening in the second shaft arm 42.

The handle 344 is then operated to rotate the threaded member 342 in the opposite direction such that the receiving assembly 332 and drive surface 360 disengage from the universal joint 22. At this point, the second shaft bushing 46 is loosened and may be easily removed from the opening in the second shaft arm 42.

The fourth example press tool 320 may thus be used in the same general manner as the first, second, and third example press tools 20, 120, and 220 to disassemble a universal joint such as the example universal joint 22. By reversing that process, the fourth example press tool 320 may, like the example press tools 20, 120, and 220, also be used to reassemble the universal joint 22.

V. Fifth Example U-Joint Tool

Figure 20:
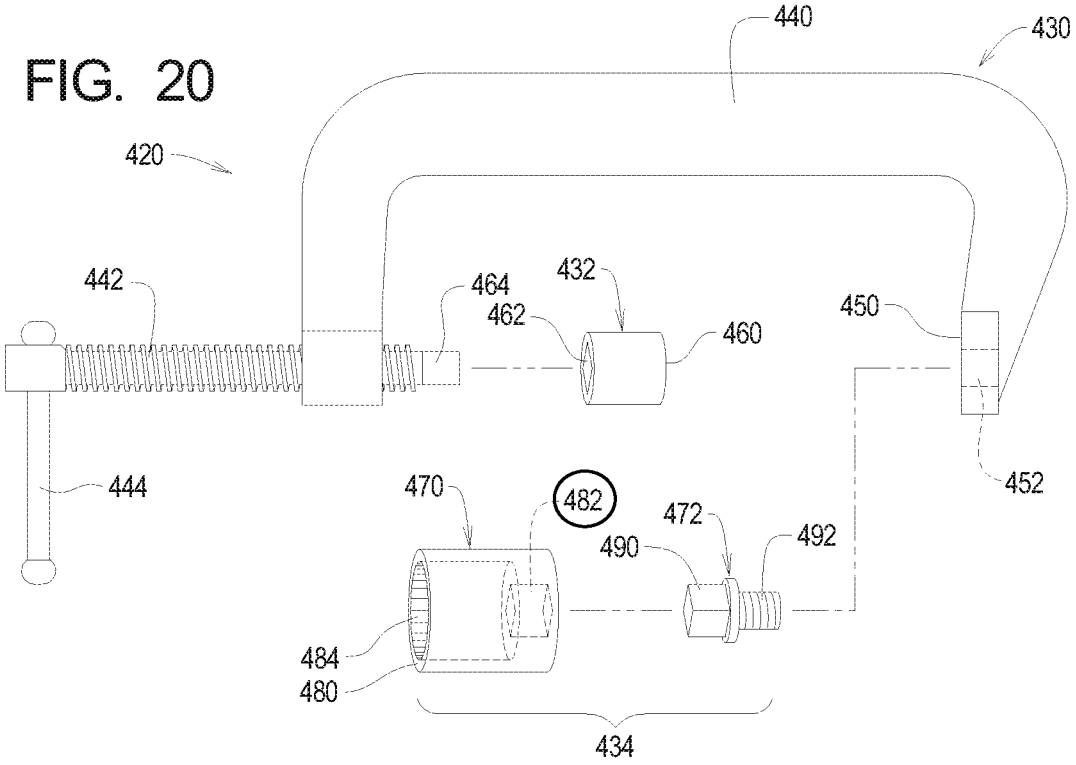
FIG. 20 is a side elevation, partial perspective, partially exploded view of a fifth example press tool of the present invention.
Figure 21:
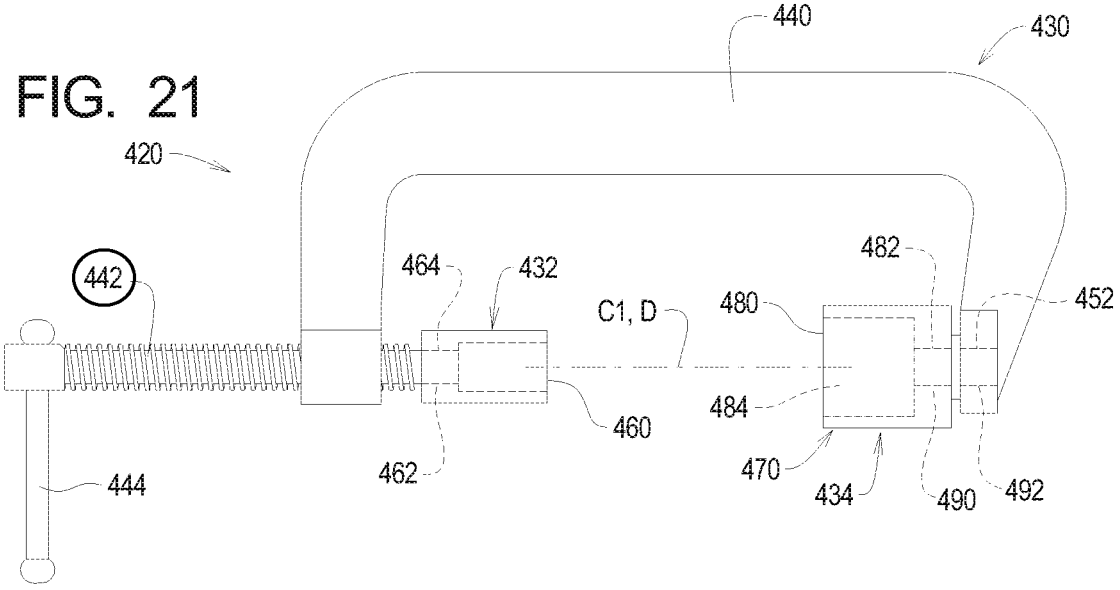
FIG. 21 is a top plan view of the fifth example press tool of the present invention.

Referring now to FIGS. 20 and 21 of the drawing, depicted therein is a fifth example press tool 420 constructed in accordance with, and embodying, the principles of the present invention. FIGS. 20 and 21 illustrate that the fifth example press tool 420 comprises a linear drive system 430, a drive member 432, and a receiving assembly 434. The first and second steps in a method of using the fifth example press tool 420 to disassemble the example universal joint 22 described above would be similar to the steps depicted in FIGS. 16 and 17.

The example linear drive system 430 comprises a base member 440, a threaded member 442, and a handle 444.

Except for as noted below, the example linear drive system 430 may be constructed and operated in manner similar to that of a conventional C-clamp and is typically not directly supported by a work surface. The base member 440 defines a base surface 450 and a first connecting portion 452. The example first connecting portion 452 is integrally formed with the base member 440 but may be detachably attached thereto. The threaded member 442 engages the base member 440 such that axial rotation of the threaded member 442 causes linear movement of the threaded member 442 relative to the base member 440. The handle 444 is arranged to facilitate axial rotation of the threaded member 442.

The drive member 432 defines a drive surface 460 and a first drive connecting portion 462. A second drive connecting portion 464 is formed on the end of the threaded member 442. The first and second drive connecting portions 462 and 464 are configured to allow the drive member 432 to be detachably attached to the threaded member 442. The example first and second drive connecting portions 462 and 464 are formed by complementary male and female square drives, but other connecting systems such as threaded holes and cavities may also be used. A drive axis D extends through the first connecting portion 452 and the drive surface 460 when the drive member 432 is detachably attached to the threaded member 442.

The receiving assembly 434 comprises a receiving member 470 and an adapter member 272. The receiving member 470 defines an engaging surface 480, a second connecting portion 482, and a receiving cavity 484. The adapter member 272 defines third and fourth connecting portions 490 and 492. The fourth connecting portion 492 is configured to engage the first connecting portion 452 to detachably attach the adapter member 472 to the base surface 450 of the base member 440. The second connecting portion 482 is configured to engage the third connecting portion 490 to detachably attach the receiving member 470 to the adapter member 472. Accordingly, with the receiving member 470 detachably attached to the adapter member 472 and the adapter member 472 detachably attached to the base member 440, the receiving member 470 is detachably attached to the base member 440.

In use, the receiving assembly 434 is detachably attached to the base member 440 using the first, second, third, and fourth connecting portions 452, 482, 490, and 492. In the example linear drive system 430, the first connecting portion 452 is formed by a threaded cavity and the fourth connecting portion 492 is formed by a threaded projection complementary to the threaded cavity forming the first connecting portion 452. Alternatively, the first and fourth connecting portions 452 and 492 may be formed by complementary square drives (one male, one female). Also in this example, the second connecting portion 482 is formed by a female square drive and the third connecting portion 490 is formed by a male square drive. The example receiving member 470 may thus be formed by standard socket drives for a socket wrench. A set of relatively inexpensive, off-the-shelf socket drives allows the user to adapt the fifth example press tool 420 to accommodate a wide variety of sizes, shapes, and configurations of universal joints in addition to the example universal joint 22.

The receiving member 470 is selected so that the receiving cavity 484 is capable of receiving (e.g., larger diameter than) the second bushing 46 and the drive surface 460 of the drive member 432 is capable of applying a driving force to the first bushing 44 as will be described in further detail below.

Assembled as described above, the fifth example press tool 420 may then be used to disassemble and/or reassemble a universal joint such as the example universal joint 22. The first two steps in the process of disassembling the example universal joint 22 using the fifth example press tool 420 are similar to those shown in FIGS. 16 and 17. The threaded member 442 and drive member 432 are initially spaced from the base surface 450 and the receiving assembly 434 detachably attached thereto a distance sufficient to allow the press tool 420 to be arranged such that the universal joint 22 is arranged relative to the press tool 420 such that the cross 34 is between the receiving assembly 434 and the drive surface 460. At this point, the first cross axis C1 is aligned with the drive axis D.

The handle 444 is then operated to rotate the threaded member 442 to displace the threaded member 442 such that the receiving assembly 434 engages the second shaft arm 42 and the drive surface 460 engages the first shaft bushing 44. Similar to what is shown in FIG. 6, continued operation of the handle 444 causes the drive surface 460 to displace the first shaft bushing 44, and thus the cross 34 and second shaft bushing 46 supported thereby, relative to the second shaft arm 42 until the second shaft bushing 46 is forced at least partly out of the opening in the second shaft arm 42 as shown in FIG. 6. The receiving cavity 484 is sized and dimensioned to receive the second shaft bushing 46 as the second shaft bushing 46 is forced out of the opening in the second shaft arm 42.

The handle 444 is then operated to rotate the threaded member 442 in the opposite direction such that the receiving assembly 434 and drive surface 460 disengage from the universal joint 22. At this point, the second shaft bushing 46 is loosened and may be easily removed from the opening in the second shaft arm 42.

The fifth example press tool 420 may thus be used in the same general manner as the first, second, and third example press tools 20, 120, 220, and 320 to disassemble a universal joint such as the example universal joint 22. By reversing that process, the fifth example press tool 420 may, like the example press tools 20, 120, 220, and 320, also be used to reassemble the universal joint 22.

VI. Sixth Example U-Joint Tool

Figure 22:
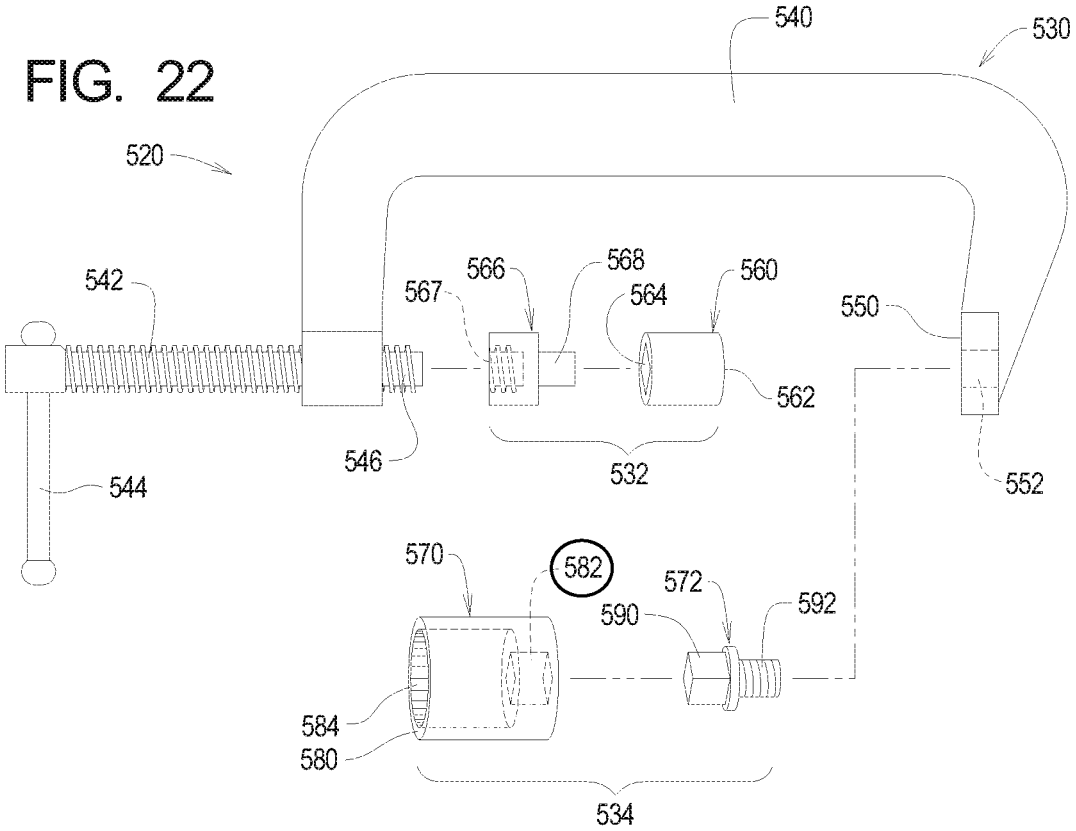
FIG. 22 is a side elevation, partial perspective, partially exploded view of a sixth example press tool of the present invention.
Figure 23:
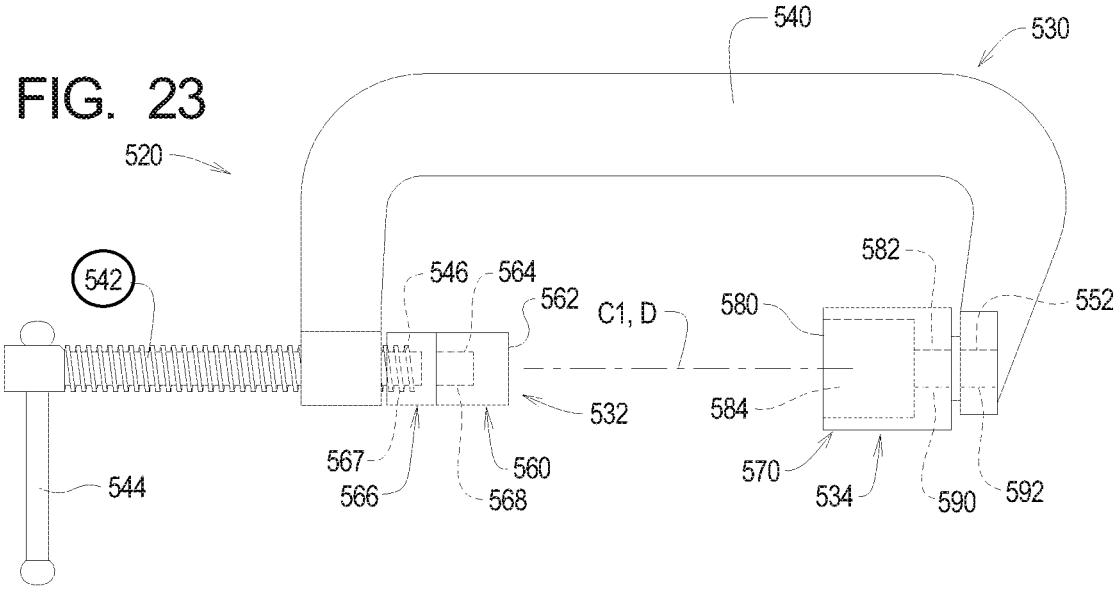
FIG. 23 is a top plan view of the sixth example press tool of the present invention.

Referring now to FIGS. 22 and 23 of the drawing, depicted therein is a sixth example press tool 520 constructed in accordance with, and embodying, the principles of the present invention. FIGS. 22 and 23 illustrate that the sixth example press tool 520 comprises a linear drive system 530, a drive assembly 532, and a receiving assembly 534. The first and second steps in a method of using the sixth example press tool 520 to disassemble the example universal joint 22 described above would be similar to the steps depicted in FIGS. 16 and 17.

The example linear drive system 530 comprises a base member 540, a threaded member 542, and a handle 544. A first drive connecting portion 546 is formed on the threaded member 542. Except for as noted below, the example linear drive system 530 may be constructed and operated in manner similar to that of a conventional C-clamp and is typically not directly supported by a work surface. The base member 540 defines a base surface 550 and a first connecting portion 552. The example first connecting portion 552 is integrally formed with the base member 540 but may be detachably attached thereto. The threaded member 542 engages the base member 540 such that axial rotation of the threaded member 542 causes linear movement of the threaded member 542 relative to the base member 540. The handle 544 is arranged to facilitate axial rotation of the threaded member 542.

The drive assembly 532 comprises a drive member 560 defining a drive surface 562 and a second drive connecting portion 564 and a drive adapter 566 defining third and fourth drive connecting portions 567 and 568. The first and third drive connecting portions 546 and 567 are configured to allow the drive adapter 566 to be detachably attached to the threaded member 542. The second and fourth drive connector portions 564 and 568 are configured to allow the drive member 560 to be detachably attached to the drive adapter 566. The example first and third drive connecting portions 546 and 567 are formed by a threaded cavity and complementary threaded projection, but other connecting systems such as a square drive may also be used. The example second and fourth connecting portions 564 and 568 are formed by a complementary square drive hole and projection. A drive axis D extends through the first connecting portion 552 and the drive surface 562 when the drive assembly 532 is detachably attached to the threaded member 542.

The receiving assembly 534 comprises a receiving member 570 and an adapter member 272. The receiving member 570 defines an engaging surface 580, a second connecting portion 582, and a receiving cavity 584. The adapter member 272 defines third and fourth connecting portions 590 and 592. The fourth connecting portion 592 is configured to engage the first connecting portion 552 to detachably attach the adapter member 572 to the base surface 550 of the base member 540. The second connecting portion 582 is configured to engage the third connecting portion 590 to detachably attach the receiving member 570 to the adapter member 572. Accordingly, with the receiving member 570 detachably attached to the adapter member 572 and the adapter member 572 detachably attached to the base member 540, the receiving member 570 is detachably attached to the base member 540.

In use, the receiving assembly 534 is detachably attached to the base member 540 using the first, second, third, and fourth connecting portions 552, 582, 590, and 592. In the example linear drive system 530, the first connecting portion 552 is formed by a threaded cavity and the third connecting portion 590 is formed by a threaded projection complementary to the threaded cavity forming the first connecting portion 552. Alternatively, the first and third connecting portions 552 and 590 may be formed by complementary square drives (one male, one female). Also in this example, the second connecting portion 582 is formed by a female square drive and the third connecting portion 590 is formed by a male square drive.

In the fifth example press tool 520, the example drive member 560 and receiving member 570 may be formed by standard socket drives for a socket wrench. A set of relatively inexpensive, off-the-shelf socket drives allows the user to adapt the sixth example press tool 520 to accommodate a wide variety of sizes, shapes, and configurations of universal joints in addition to the example universal joint 22.

The receiving member 570 is selected so that the receiving cavity 584 is capable of receiving (e.g., larger diameter than) the second bushing 46 and the drive surface 562 of the drive member 560 is capable of applying a driving force to the first bushing 44 as will be described in further detail below.

Assembled as described above, the sixth example press tool 520 may then be used to disassemble and/or reassemble a universal joint such as the example universal joint 22. The first two steps in the process of disassembling the example universal joint 22 using the sixth example press tool 520 are similar to those shown in FIGS. 16 and 17. The threaded member 542 and drive assembly 532 are initially spaced from the base surface 550 and the receiving assembly 534 detachably attached thereto a distance sufficient to allow the press tool 520 to be arranged such that the universal joint 22 is arranged relative to the press tool 520 such that the cross 34 is between the receiving assembly 534 and the drive surface 562. At this point, the first cross axis C1 is aligned with the drive axis D.

The handle 544 is then operated to rotate the threaded member 542 to displace the threaded member 542 such that the receiving assembly 534 engages the second shaft arm 42 and the drive surface 562 engages the first shaft bushing 44. Similar to what is shown in FIG. 6, continued operation of the handle 544 causes the drive surface 562 to displace the first shaft bushing 44, and thus the cross 34 and second shaft bushing 46 supported thereby, relative to the second shaft arm 42 until the second shaft bushing 46 is forced at least partly out of the opening in the second shaft arm 42. The receiving cavity 584 is sized and dimensioned to receive the second shaft bushing 46 as the second shaft bushing 46 is forced out of the opening in the second shaft arm 42.

The handle 544 is then operated to rotate the threaded member 542 in the opposite direction such that the receiving assembly 534 and drive surface 580 disengage from the universal joint 22. At this point, the second shaft bushing 46 is loosened and may be easily removed from the opening in the second shaft arm 42.

The sixth example press tool 520 may thus be used in the same general manner as the example press tools 20, 120, 220, 320, and 420 disassemble a universal joint such as the example universal joint 22. By reversing that process, the sixth example press tool 520 may, like the example press tools 20, 120, 220, 320, and 420, also be used to reassemble the universal joint 22.

VI. Seventh Example U-Joint Tool

Figure 24:
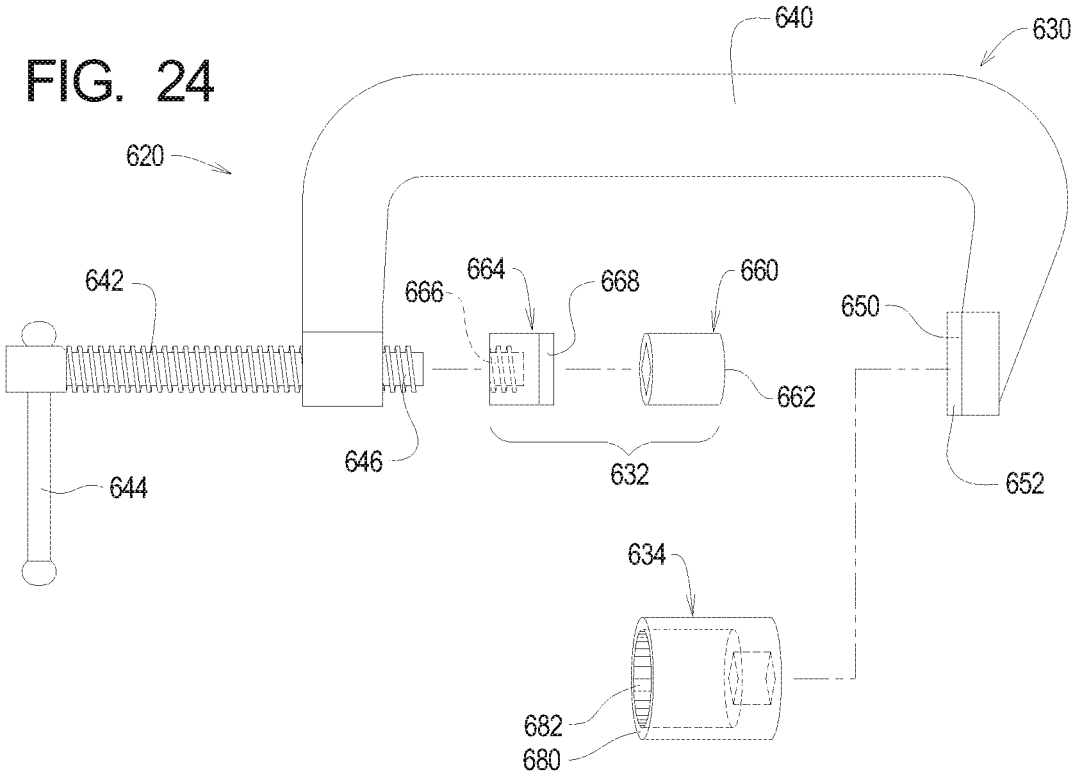
FIG. 24 is a side elevation, partial perspective, partially exploded view of a seventh example press tool of the present invention.
Figure 25:
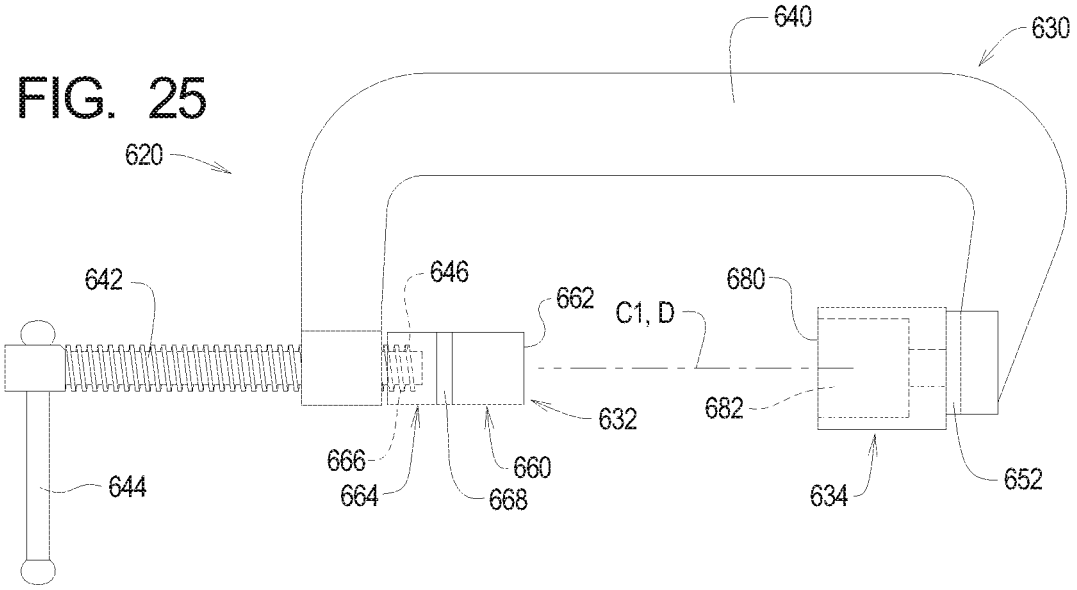
FIG. 25 is a top plan view of the seventh example press tool of the present invention.

Referring now to FIGS. 24 and 25 of the drawing, depicted therein is a seventh example press tool 620 constructed in accordance with, and embodying, the principles of the present invention. FIGS. 24 and 25 illustrate that the seventh example press tool 620 comprises a linear drive system 630, a drive assembly 632, and a receiving member 634. The first and second steps in a method of using the seventh example press tool 620 to disassemble the example universal joint 22 described above would be similar to the steps depicted in FIGS. 16 and 17 of the drawing.

The example linear drive system 630 comprises a base member 640, a threaded member 642, and a handle 644. A first drive connecting portion 646 is formed on the threaded member 642. Except for as noted below, the example linear drive system 630 may be constructed and operated in manner similar to that of a conventional C-clamp and is typically not directly supported by a work surface. The base member 640 defines a base surface 650 and a base connecting portion 652. The example base connecting portion 652 is formed by a layer of magnetic material rigidly or detachably attached to the base member 640 to define the base surface 650. The threaded member 642 engages the base member 640 such that axial rotation of the threaded member 642 causes linear movement of the threaded member 642 relative to the base member 640. The handle 644 is arranged to facilitate axial rotation of the threaded member 642.

The drive assembly 632 comprises a drive member 660 defining a drive surface 662 and a drive adapter 664 defining first and second adapter connecting portions 666 and 668. The drive connecting portion 646 and first adapter connecting portion 666 are configured to allow the drive adapter 664 to be detachably attached to the threaded member 642. The second adapter connector portion 668 is configured to allow the drive member 660 to be detachably attached to the drive adapter 664. The example drive and first adapter connecting portions 646 and 666 are formed by a threaded cavity and complementary threaded projection, but other connecting systems such as a square drive may also be used. The example second adapter connecting portion 668 is formed by a magnetic material that is rigidly or detachably attached to the drive adapter 664. A drive axis D extends through the base connecting portion 652 and the drive surface 662 when the drive assembly 632 is detachably attached to the threaded member 642.

The receiving member 634 defines an engaging surface 680 and a receiving cavity 682.

In the fifth example press tool 620, the example drive member 660 and receiving member 634 may be formed by standard socket drives for a socket wrench. A set of relatively inexpensive, off-the-shelf socket drives allows the user to adapt the seventh example press tool 620 to accommodate a wide variety of sizes, shapes, and configurations of universal joints in addition to the example universal joint 22. Further, drive sockets are made of magnetically attractable material such as steel. Accordingly, the drive member 660 and receiving member 634 may be detachably attached to the threaded member 652 and the base member 640 by simply placing the members 660 and 634 against the first drive connecting portion 646 and the base connecting portion 642, respectively. When magnetically supported relative to the threaded member 642 and base member 640, respectively, the drive member 660 and the receiving member 634 are aligned along the drive axis D.

The drive member 632 and the receiving member 634 are initially detachably attached to threaded member 642 and the base member 640, respectively. The receiving member 670 is selected so that the receiving cavity 682 is capable of receiving (e.g., larger diameter than) the second bushing 46 and the drive surface 662 of the drive member 660 is capable of applying a driving force to the first bushing 44 as will be described in further detail below.

Assembled as described above, the seventh example press tool 620 may then be used to disassemble and/or reassemble a universal joint such as the example universal joint 22. The first two steps in the process of disassembling the example universal joint 22 using the seventh example press tool 620 are similar to those shown in FIGS. 16 and 17. The threaded member 642 and drive assembly 632 are initially spaced from the base surface 650 and the receiving assembly 634 detachably attached thereto a distance sufficient to allow the press tool 620 to be arranged such that the universal joint 22 is arranged relative to the press tool 620 such that the cross 34 is between the receiving assembly 634 and the drive surface 662. At this point, the first cross axis C1 is aligned with the drive axis D.

The handle 644 is then operated to rotate the threaded member 642 to displace the threaded member 642 such that the receiving assembly 634 engages the second shaft arm 42 and the drive surface 662 engages the first shaft bushing 44. Similar to what is shown in FIG. 6, continued operation of the handle 644 causes the drive surface 662 to displace the first shaft bushing 44, and thus the cross 34 and second shaft bushing 46 supported thereby, relative to the second shaft arm 42 until the second shaft bushing 46 is forced at least partly out of the opening in the second shaft arm 42. The receiving cavity 682 is sized and dimensioned to receive the second shaft bushing 46 as the second shaft bushing 46 is forced out of the opening in the second shaft arm 42.

The handle 644 is then operated to rotate the threaded member 642 in the opposite direction such that the receiving assembly 634 and drive surface 680 disengage from the universal joint 22. At this point, the second shaft bushing 46 is loosened and may be easily removed from the opening in the second shaft arm 42.

The seventh example press tool 620 may thus be used in the same general manner as the example press tools 20, 120, 220, 320, 420, and 520 to disassemble a universal joint such as the example universal joint 22. By reversing that process, the seventh example press tool 620 may, like the example press tools 20, 120, 220, 320, 420, and 520, also be used to reassemble the universal joint 22.

The example linear drive systems 30, 130, 230, 330, 430, 530, and 630 are all hand-operated mechanical devices employing a threaded rod. Alternatively, hand-operated levers and/or cams or hydraulic or pneumatic pistons may be used as the linear drive system of the present invention. Alternatively, the present invention may include a powered linear drive system capable of developing the forces necessary to disassemble a universal joint. As examples, an electric, hydraulic, or pneumatic motor may be used to rotate a threaded member such as the threaded members 74, 144, 242, 342, 442, 542, and 642 described herein. Other examples of suitable powered linear drive systems include hydraulic or pneumatic pistons.

What is claimed is:

1. A press tool for using a plurality of socket drives each defining a square drive cavity, a socket cavity, and a socket perimeter surface extending around the socket cavity to displace a first part relative to a second part, the press tool comprising:

a drive system defining first and second drive portions, where the drive system is configured to allow at least one the first and second drive portions to be displaced relative to at least one of the first and second drive portions along a drive axis;

a first square drive projection supported by the first drive portion; and a second square drive projection supported by the second portion; whereby the first square drive projection is adapted to be received at least partly within the square drive cavity of a first selected socket drive of the plurality of socket drives to allow the first selected drive socket to be detachably attached to the first drive portion such that the socket cavity of a first selected drive socket selected from the plurality of socket drives defines a receiving cavity, and the socket perimeter surface of the first selected drive socket defines an engaging surface;

the second square drive projection is adapted to be received at least partly within the square drive cavity of a second selected socket drive of the plurality of socket drives to allow the second selected drive socket to be detachably attached to the second drive portion such that the socket perimeter surface of the second selected drive socket defines a drive surface.

2. A press tool as recited in claim 1, in which, when the first selected socket drive is supported by the first drive portion and the second selected socket drive is supported by the second drive portion, operation of the drive system displaces the drive surface relative to the engaging surface and the receiving cavity along the drive axis to displace the first part relative to the second part such that at least a portion of the first part enters at least a portion of the receiving cavity.

3. A press tool as recited in claim 1, in which the first square drive projection is integrally formed with the first drive portion.

4. A press tool as recited in claim 1, in which in which the second square drive projection is integrally formed with the second drive portion.

5. A press tool as recited in claim 1, in which:

the first square drive projection is integrally formed with the first drive portion; and the second square drive projection is integrally formed with the second drive portion.

6. A press tool as recited in claim 1, further comprising a first base member defining the first square drive projection, where the first base member is detachably attached to the first drive portion.

7. A press tool as recited in claim 1, further comprising a second base member defining the second square drive projection, where the second base member is detachably attached to the second drive portion.

8. A press tool as recited in claim 1, further comprising:

a first base member defining the first square drive projection, where the first base member is detachably attached to the first drive portion; and a second base member defining the first square drive projection, where the second base member is detachably attached to the second drive portion.

9. A press tool system for displacing a first part relative to a second part, the press tool comprising:

a plurality of socket drives each defining a square drive cavity, a socket cavity, and a socket perimeter surface extending around the socket cavity;

a drive system defining first and second drive portions, where the drive system is configured to allow at least one the first and second drive portions to be displaced relative to at least one of the first and second drive portions along a drive axis;

a first square drive projection supported by the first drive portion;

a second square drive projection supported by the second portion; whereby at least a portion of the first square drive projection is received by the square drive cavity of a first selected socket drive of the plurality of socket drives to allow the first selected drive socket to be detachably attached to the first drive portion such that the socket cavity of a first selected drive socket selected from the plurality of socket drives defines a receiving cavity, and the socket perimeter surface of the first selected drive socket defines an engaging surface;

at least a portion of the second square drive projection is received by the square drive cavity of a second selected socket drive of the plurality of socket drives to allow the second selected drive socket to be detachably attached to the second drive portion such that the socket perimeter surface of the second selected drive socket defines a drive surface; and when the first selected socket drive is supported by the first drive portion and the second selected socket drive is supported by the second drive portion, operation of the drive system displaces the drive surface relative to the engaging surface and the receiving cavity along the drive axis to displace the first part relative to the second part such that at least a portion of the first part enters at least a portion of the receiving cavity.

10. A press tool as recited in claim 9, in which the first square drive projection is integrally formed with the first drive portion.

11. A press tool as recited in claim 9, in which in which the second square drive projection is integrally formed with the second drive portion.

12. A press tool as recited in claim 9, in which:

the first square drive projection is integrally formed with the first drive portion; and the second square drive projection is integrally formed with the second drive portion.

13. A press tool as recited in claim 9, further comprising a first base member defining the first square drive projection, where the first base member is detachably attached to the first drive portion to define the first square drive projection.

14. A press tool as recited in claim 9, further comprising a second base member defining the second square drive projection, where the second base member is detachably attached to the second drive portion to define the second square drive projection.

15. A press tool as recited in claim 9, further comprising:

a first base member defining the first square drive projection, where the first base member is detachably attached to the first drive portion to define the first square drive projection; and a second base member defining the second square drive projection, where the second base member is detachably attached to the second drive portion to define the second square drive projection.

* * * * *